United States Patent [19]

Sato et al.

[11] Patent Number: 4,546,746

[45] Date of Patent: Oct. 15, 1985

[54] INJECTOR FOR MULTICYLINDER INTERNAL COMBUSTION ENGINES

[75] Inventors: Toshihiko Sato, Saitama; Tetsuo Yamagata, Tokyo, both of Japan

[73] Assignee: Honda Giken Kogyo Kabushiki Kaisha, Tokyo, Japan

[21] Appl. No.: 644,917

[22] Filed: Aug. 27, 1984

[30] Foreign Application Priority Data

Sep. 3, 1983 [JP] Japan ..... 58-162142

[51] Int. Cl.[4] ..... F02M 39/00; F02D 13/06

[52] U.S. Cl. ..... 123/478; 123/472; 123/445

[58] Field of Search ..... 123/472, 478, 445

[56] References Cited

U.S. PATENT DOCUMENTS

| | | | |
|---|---|---|---|
| 4,174,681 | 11/1979 | Lachaco | 123/478 |
| 4,216,753 | 8/1980 | Inoue et al. | 123/472 |
| 4,258,674 | 3/1981 | Wolff | 123/472 |
| 4,290,394 | 9/1981 | Frank et al. | 123/472 |
| 4,347,823 | 9/1982 | Kessler et al. | 123/472 |
| 4,383,514 | 5/1983 | Fiala | 123/478 |
| 4,383,515 | 5/1983 | Higashiyama et al. | 123/478 |
| 4,418,673 | 12/1983 | Tominari et al. | 123/478 |
| 4,433,381 | 2/1984 | Wilkinson | 123/478 |

*Primary Examiner*—Raymond A. Nelli

*Attorney, Agent, or Firm*—Lyon & Lyon

[57] ABSTRACT

A fuel injection system for a multibank engine having separate intake manifolds and throttle valves for each bank. Separate manifold pressure sensors for each bank are employed to determine injection signals for corresponding cylinders within each bank.

2 Claims, 10 Drawing Figures

INJECTOR FOR MULTICYLINDER INTERNAL COMBUSTION ENGINES

BACKGROUND OF THE INVENTION

The field of the present invention is injection control systems for internal combustion engines of a multicylinder design.

Fuel injection systems have been developed in recent years which are capable of controlling injection timing impulses responsive to a plurality of engine conditions and operating modes. Such systems generally employ electrical control units which measure such things as the location of the engine camshaft for timing, a pressure sensor for engine manifold pressure, a throttle position sensor and the like. Such systems detect the rotational sensor and pressure sensor inputs, convert the inputs to a control signal which actuates an injector actuator at the injector nozzle. In this way, timing and quantity of injection may be controlled.

Such systems have come to be employed for such advantageous uses as increased performance and increased fuel economy. With sufficient complexity, greater control can generally be achieved with an injection system than with carburetion. For improved mixture control, accurate sensing becomes of greater importance. However, injection systems are relatively expensive and general control units have been configured in single groups of components.

With multicylinder engines and especially such engines having multiple banks of cylinders, such unitary sensor groups have been located at representative locations for sensing engine conditions. A manifold pressure sensor may be located in one location within a common manifold or in one of two manifolds to provide input into the injector control unit. Such practice does not provide sufficient accuracy to obtain maximum benefit from such an injection system. Errors, signal incompatibility and inaccurate control can result from variations between banks of cylinders.

SUMMARY OF THE INVENTION

The present invention is directed to a fuel injection system providing accurate control for a multicylinder engine and particularly for an engine having multiple cylinder banks. Such banks may each include one or more cylinders. Additional control is achieved through the employment of an intake manifold for each bank of cylinders with a separate intake throttle valve for each manifold. Sensors are located in each manifold for sensing manifold pressure. Injectors associated with each cylinder may then be controlled by the injector control unit responsive to the conditions within the manifold associated with the appropriate cylinder bank. Engine rotation sensors, throttle position sensors, temperature sensors and ambient air pressure sensors which reflect engine conditions not particularly directed to any cylinder bank may continue to provide input for control of all banks.

Accordingly, it is an object of the present invention to provide an improved injection control system for a multicylinder internal combustion engine for accurate fuel injection. Other and further objects and advantages will appear hereinafter.

DETAILED DESCRIPTION OF THE PREFERRED EMBODIMENT

Figure 1:
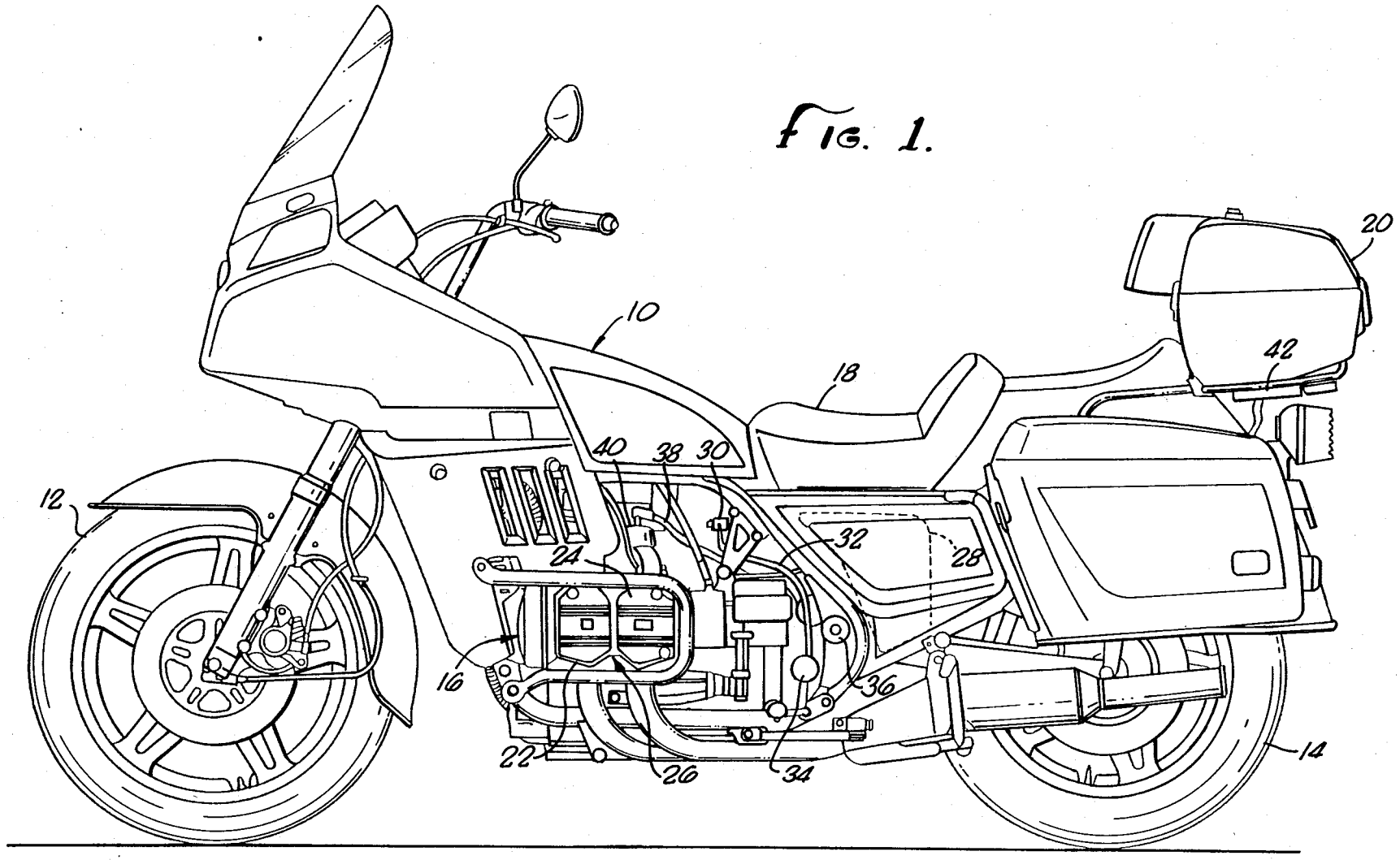
FIG. 1 is a side elevation of a motorcycle employing a fuel injection system.

Turning in detail to the drawings, FIG. 1 illustrates a motorcycle having two banks of cylinders and a fuel injection system. The motorcycle includes a body 10 with conventionally arranged front wheel 12, rear wheel 14 and engine 16. A seat 18 is located on the body 10 along with carrier units 20. The engine 16 is shown to include cylinders 22 and 24 with the left bank, generally designated 26, being illustrated.

The fuel system for the motorcycle illustrated in FIG. 1 includes a fuel tank 28 from which fuel is supplied via a fuel cock 30, a fuel line 32 and a fuel filter 34 to a fuel pump 36. From the fuel pump 36, fuel is distributed to the injectors through pipes 38 to the injectors 40. A control unit 42, conveniently located under the carrier 20, electronically controls operation of the fuel system.

Figure 2:
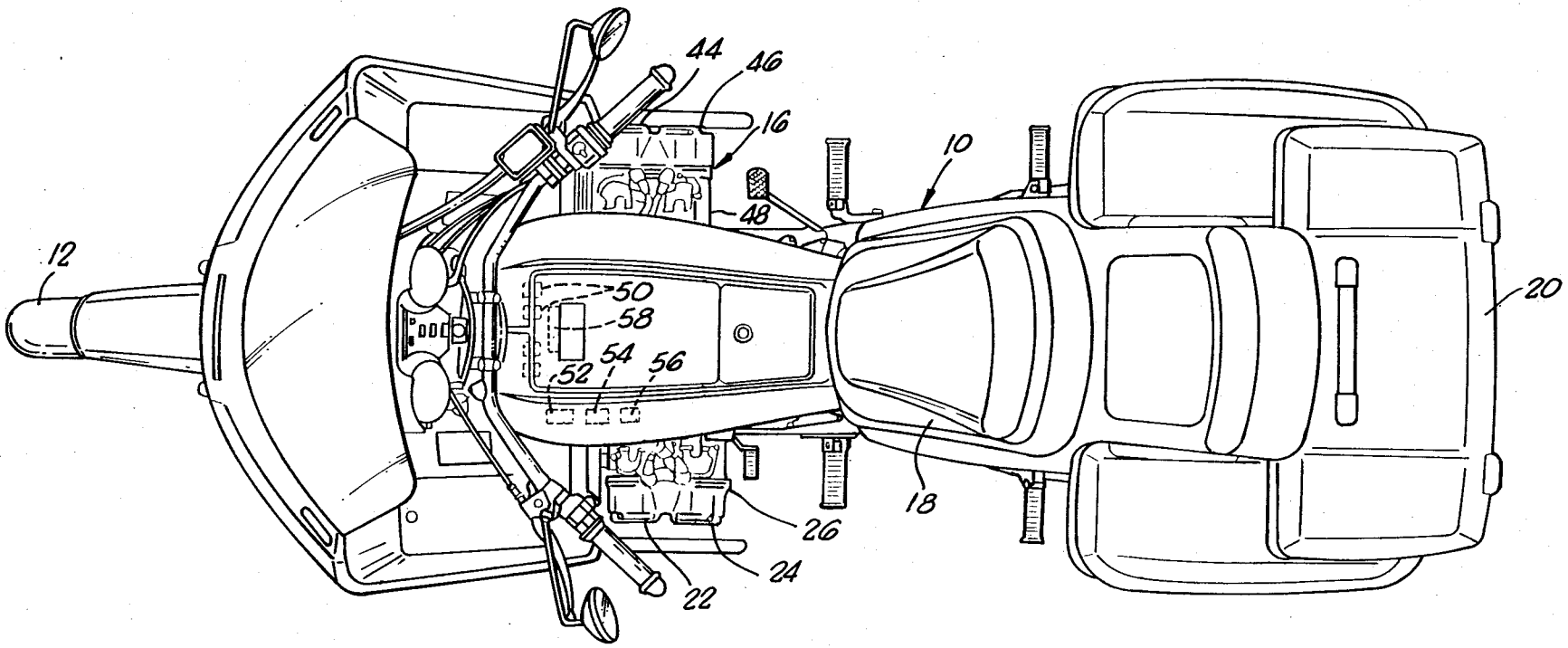
FIG. 2 is a plan view of the motorcycle of FIG. 1.

Looking specifically at FIG. 2, cylinders 44 and 46 of the right bank 48 of cylinders can be seen. In this view, the location of various components are indicated as being positioned under the cover of the body 10. Several components of electrical equipment are illustrated at 50. Convenient locations for various sensors are also shown including an ambient air pressure sensor 52, a left bank manifold pressure sensor 54 and a right bank manifold pressure sensor 56. An auto kill switch sensor 58 is also illustrated.

Figure 3:
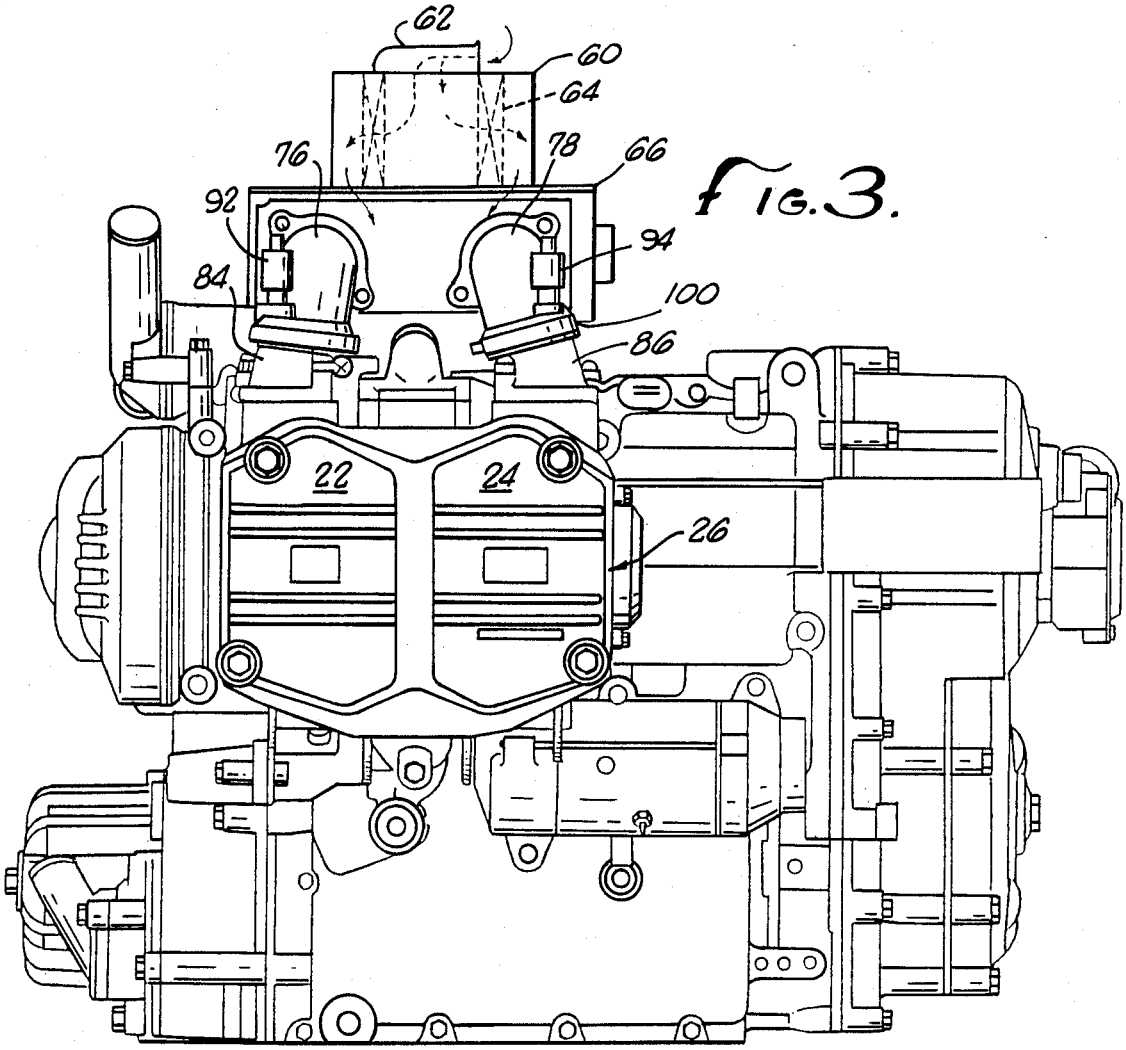
FIG. 3 is a detail elevation of a motorcycle engine employing a fuel injection system.
Figure 4:
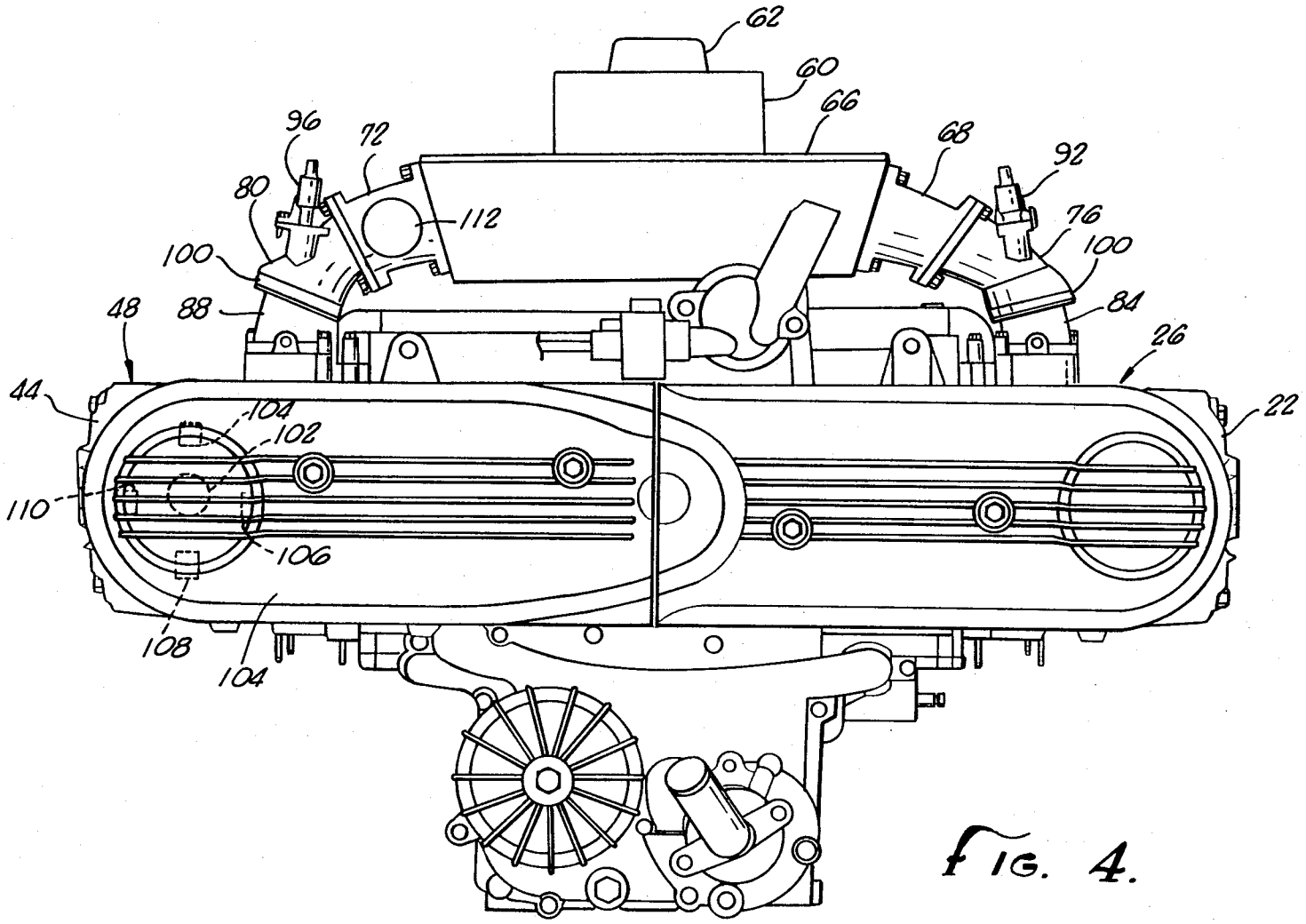
FIG. 4 is a front elevation of the engine of FIG. 3.
Figure 5:
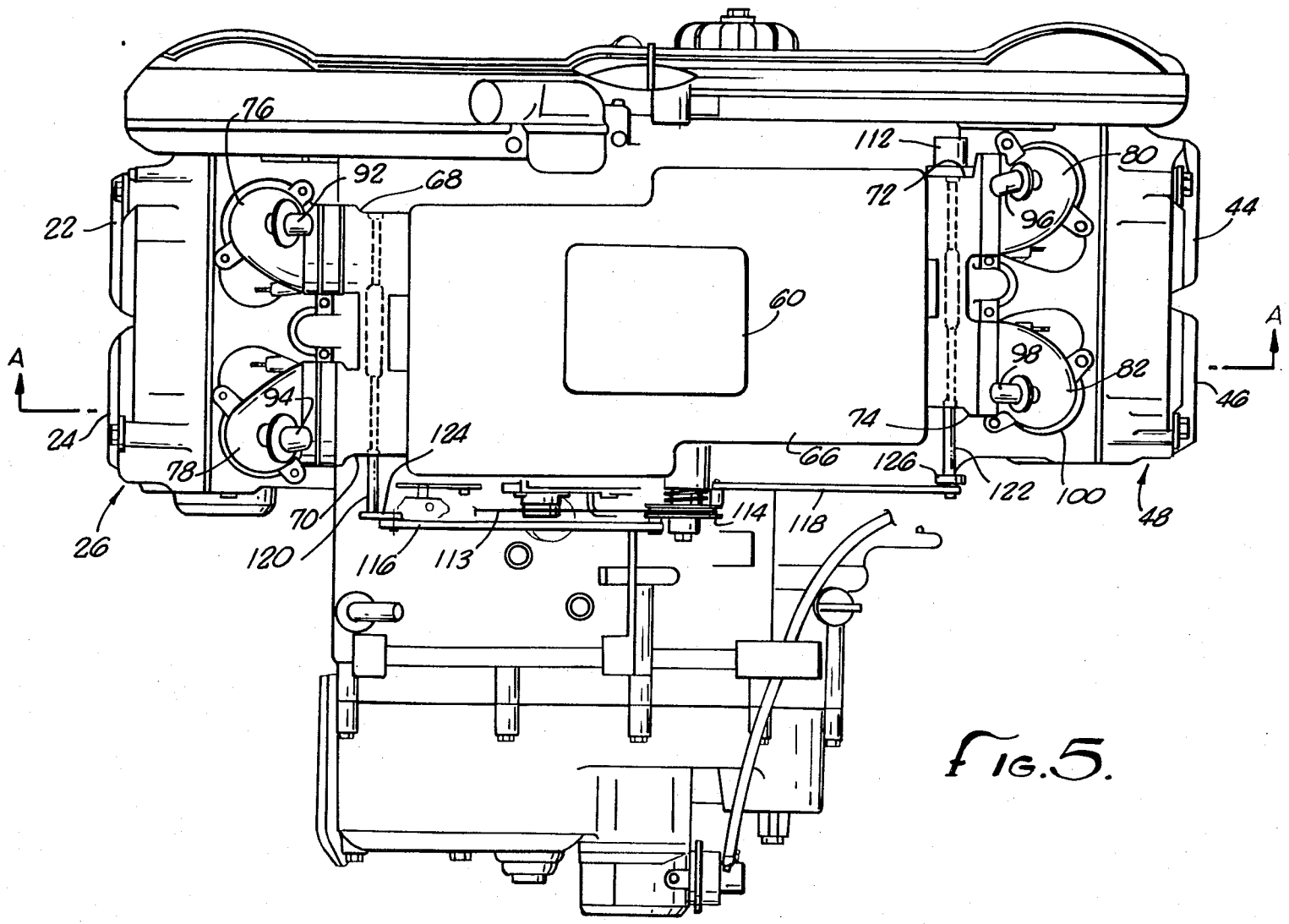
FIG. 5 is a top elevation of the engine of FIG. 3.
Figure 6:
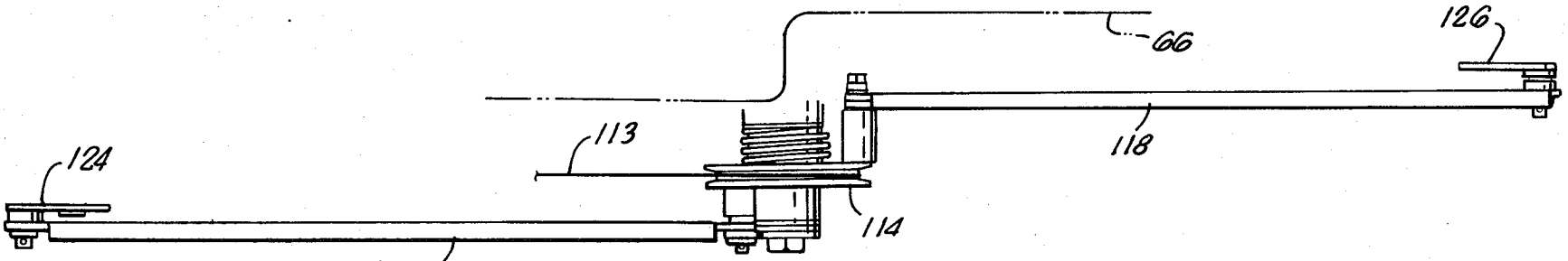
FIG. 6 is a detail plan view of the throttle linkage of the engine of FIG. 3.
Figure 7:
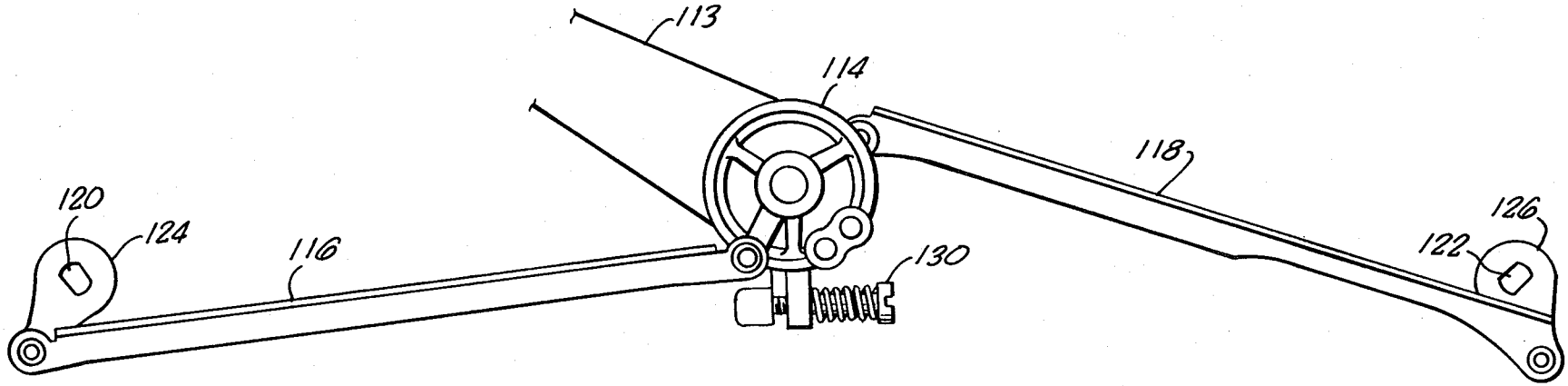
FIG. 7 is a plan view of the throttle linkage of FIG. 6.

Looking next to FIGS. 3, 4 and 5, the engine is specifically illustrated. An air cleaner 60 is employed for filtering incoming air from an air inlet 62 through a filter element 64. Air is then directed through an air cleaner base 66 to two manifold assemblies, one for each bank. In these assemblies, the air passes through throttle body pipes 68, 70, 72 and 74, injector body pipes 76, 78, 80 and 82 and intake pipes 84, 86, 88 and 90 to the cylinders 22, 24, 44 and 46, respectively. Injector nozzles 92, 94, 96 and 98 are associated with the injector body pipes 76, 78, 80 and 82, respectively. Rubber dampers 100 are located at the joints of the injector body pipes and intake pipes.

As can best be seen in FIG. 4, a camshaft 102 is shown to extend along the right bank 48. This camshaft 102 is driven by a timing belt located beneath the timing belt cover 104. A similar camshaft and drive arrangement is provided for the left bank 26. Associated with the camshaft 102 are position sensors 104, 106, 108 and 110. The position sensors are employed in regulation of the injection control. A throttle opening sensor 112 located on the throttle body pipe 72 also provides input to the injection control system.

The throttles linkage mechanism is illustrated in FIGS. 5 through 8. A throttle cable 113 communicates with the throttle control of the motorcycle. The cable is directed about a drum 114. The drum 114 is in turn pinned to throttle links 116 and 118. These links are in turn connected with throttle shafts 120 and 122 by means of levers 124 and 126. Consequently, rotation of the drum 114 results in rotation of the throttle shafts 120 and 122. The throttle shafts 120 and 122 extend into the throttle body pipes to butterfly valves 128 located in each throttle body pipe. An adjustment screw 130 controls the maximum displacement of the throttle linkage. Additional screws 132 and 134 provide control over throttle valve adjustment.

Figure 9:
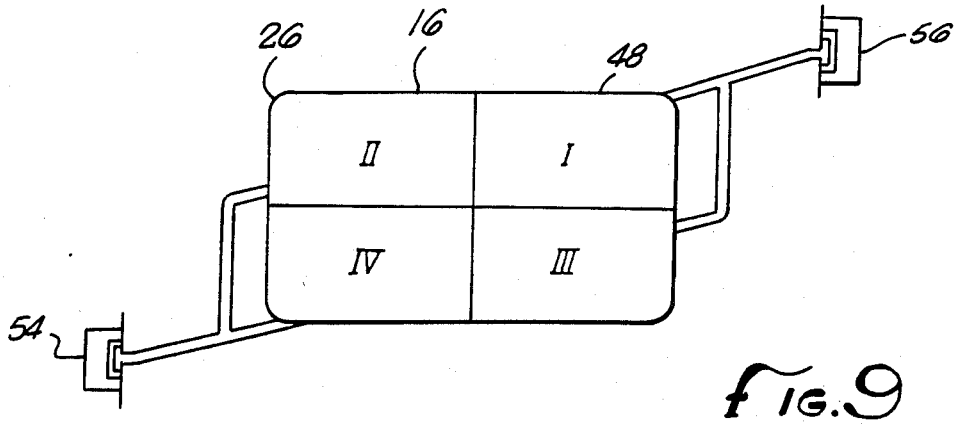
FIG. 9 is a schematic view of the pressure sensor piping associated with the engine.
Figure 8:
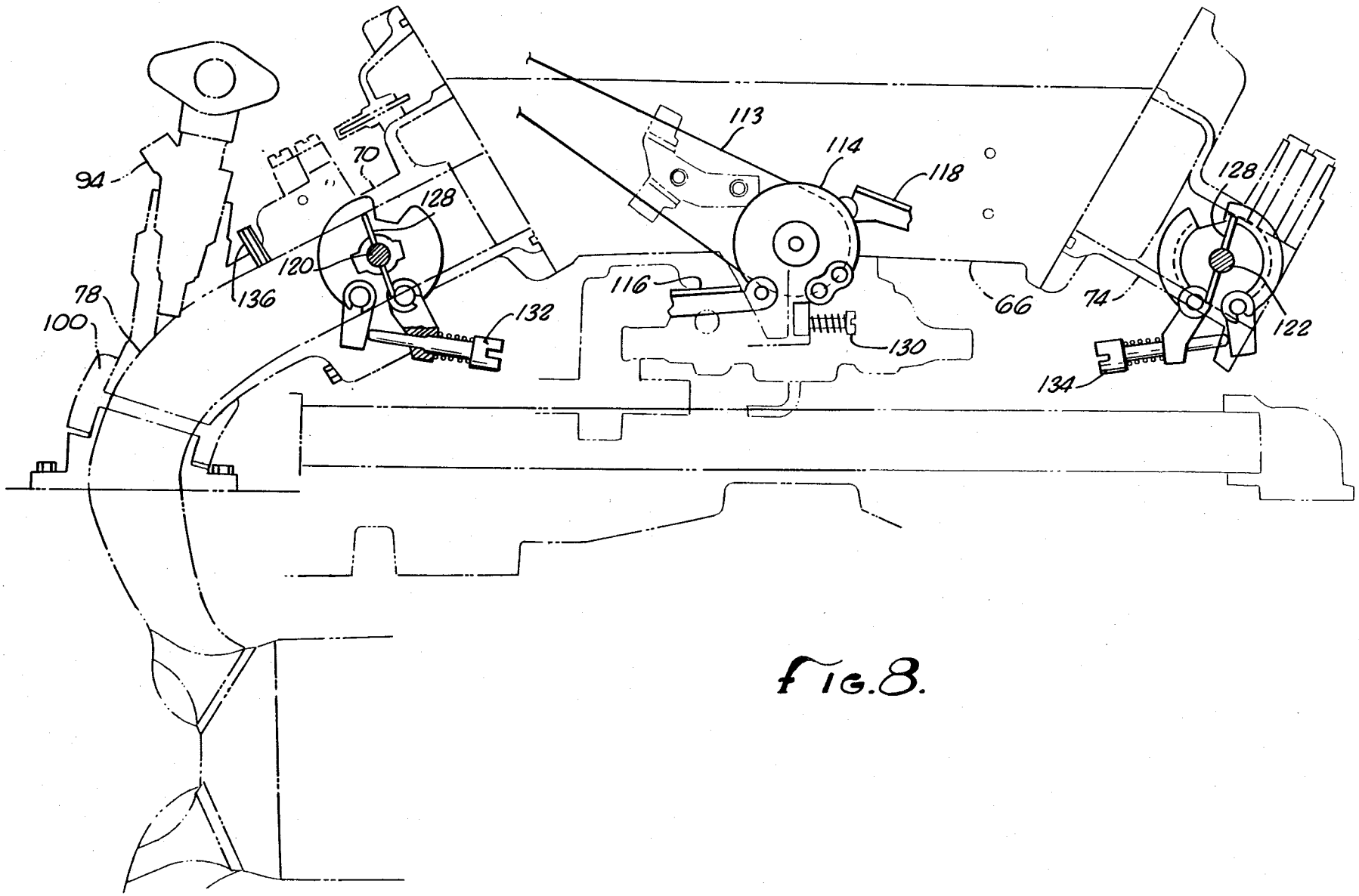
FIG. 8 is a schematic plan view of the throttle valves and intake system of the engine of FIG. 3.

Illustrated in FIG. 8 is a nipple 136 which provides access to the manifold defined by the throttle body pipes, injector body pipes and intake pipes for each bank. Manifold pressure directed to the left bank pressure sensor 54 is communicated from the access nipple 136. FIG. 9 illustrates schematically the sensors 54 and 56 associated with the banks 26 and 48 of cylinders in the engine 16.

Figure 10:
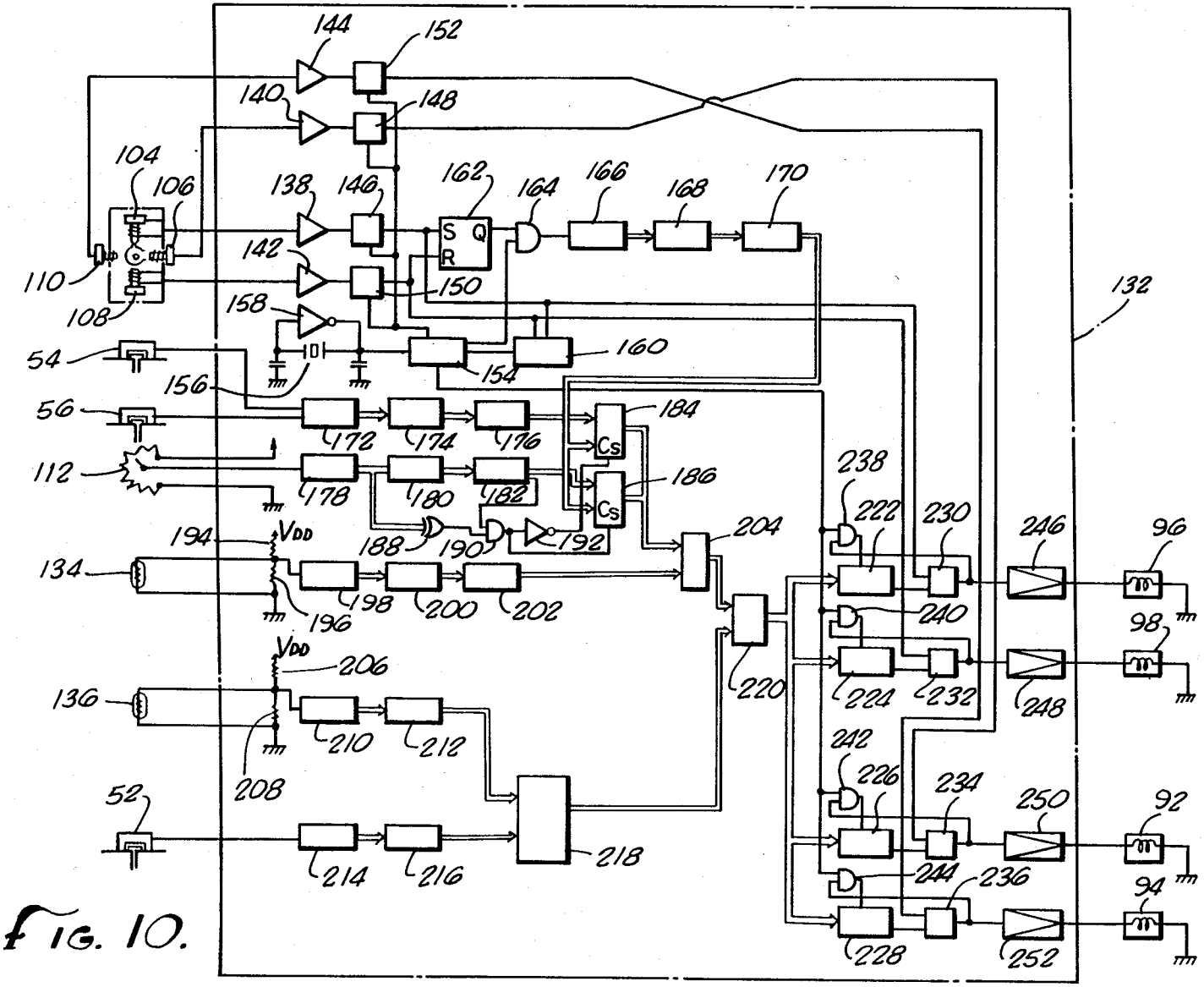
FIG. 10 is a schematic logic diagram of the injector control system.

Turning then to the schematic of FIG. 10, an injector control means is illustrated for controlling the valves of the injectors 92, 94, 96 and 98 responsive to certain engine conditions. Illustrated sensors providing input to the injector control means 132 include position sensors 104, 106, 108 and 110, the left bank pressure sensor 54, the right bank pressure sensor 56, the throttle opening sensor 112 and the pressure sensor for ambient air 52 which is located in the air cleaner downstream of the filter element 64. Also illustrated is an engine coolant temperature sensor 134 and an ambient air temperature sensor 136. The coils associated with the valve of the injectors 92, 94, 96 and 98 are illustrated to the right of the injector control means 132.

Generally speaking, the components associated with the position sensors provide an initiation signal determinative of when each injector is to be activated. Each piston position sensor 104, 106, 108 and 110 produces an output value which is conditioned by a Schmidt trigger 138, 140, 142 and 144, respectively. Each Schmidt trigger provides an output value which is connected to a clock differentiator 146, 148, 150 and 152, respectively, which collectively produce an output signal which is input to a mixer 154. Also input to the mixer 154 is a clock signal produced by a crystal oscillator 156 and inverting buffer 158 combination. The output of the mixer 154 is connected, along with the clock differentiators 146 and 148 associated with cylinders 44 and 22, to a timing control circuit 160. Outputs from the clock differentiators 146 and 150 are connected to the "set" and "reset" inputs of a flip-flop 162, alternately setting and resetting the flip-flop 162 when different injectors are ready to be energized. The flip-flop state and an output line of the mixer 154 are combined by AND gate 164. The result is used to clock a counter 166. The counter value is stored by a latch 168 and the result used to address a ROM 170.

Associated with the cylinder bank pressure sensors 54 and 56 are components separately determining signal inputs for corresponding injectors to separately control each cylinder bank. Pressure sensors 54 and 56 input analog values to an A-D converter 172, which alternately senses one and then the other of the signals. The A-D converter digital output value is stored by a latch 174 and is used to address a ROM 176. Similarly, the throttle position sensor 112 produces an analog value which is input to the A-D converter 178 whose digital output value is stored by a latch 180 which is in turn used to address a ROM 182. The outputs of ROMS 176 and 182 are then combined with the output of ROM 170 and input to devices 184 and 186.

An XOR (exclusive OR) gate 188 tests the digital value which is input to the latch 180. The result is combined with an output line of the ROM 176 by an AND gate 190. The AND gate 190 produces a clock signal which, together with its inverted version produced by the inverter 192, is used to clock the operation of the devices 184 and 186. Note that this establishes that one, but not both, of these two devices 184 and 186 will operate at any given time.

Associated with the engine coolant temperature sensor 134 and ambient air temperature sensor 136 are components which modify the signals responsive to the manifold pressure sensors and throttle position sensor. The coolant sensor 134 produces an analog output value. This is modified by a voltage divider created by two resistors 194 and 196. The modified value is input to an A-D converter 198. The digital output value resulting is stored by a latch 200 and used as input to a ROM 202. The output of this ROM 202 is combined with the output devices of 184 and 186 by a multiplier 204.

Similarly, the temperature sensor 136 for the clean side of the air cleaner produces an analog output value which is modified by a voltage divider created by two resistors 206 and 208. The modified value is input to an A-D converter 210. The digital output value resulting from the A-D converter 210. is stored by a latch 212. The pressure sensor 52 for ambient pressure as recorded within the air cleaner produces an analog output value which is input to an A-D converter 214 and then stored in a latch 216. The values stored in the latches 212 and 216 are combined by a multiplier 218. The result is then combined with the output of the multiplier 204 at a multiplier 220.

The results from the multiplier 220 are connected to preset topple counters 222, 224, 226 and 228. These devices are connected to the "reset" input of flip-flops 230, 232, 234 and 236, respectively. The output of the flip-flops are also used as feedback values and combined with an output line from the mixer 154 by AND gates 238, 240, 242 and 244. The output is also used as input to the present topple counters. Amplifiers 46, 248, 250 and 252 then activate the coils of the injectors for each of cylinders 44, 46, 22 and 24.

Thus, an injector system for multicylinder internal combustion engines is disclosed which provides improved injector efficiency through injection control responsive to pressure within each of the banks of cylinders. While embodiments and applications of this invention have been shown and described, it would be apparent to those skilled in the art that many more modifications are possible without departing from the inventive concepts herein. The invention, therefore, is not to be restricted except in the spirit of the appended claims.

What is claimed is:

1. An injector system for an engine having a first cylinder bank with a first intake manifold and a first throttle valve associated therewith and a second cylinder bank with a second intake manifold and a second throttle valve associated therewith, the first and second throttle valves having a common throttle control, comprising a first pressure sensor in communication with the first intake manifold downstream of the first throttle valve;

a second pressure sensor in communication with the second intake manifold downstream of the second throttle valve;

first fuel injectors, each said first fuel injector being directed to a cylinder of the first cylinder bank;

second fuel injectors, each said second fuel injector being directed to a cylinder of the second cylinder bank; and injector control means for controlling said first injectors responsive to said first pressure sensor and said second injectors responsive to said second pressure sensor.

2. The injector system of claim 1 further comprising a rotation sensor for the engine, said injector control means further controlling said first and second injectors responsive to said engine rotation sensor.

* * * * *